US010865589B2

(12) United States Patent
Pettengill et al.

(10) Patent No.: US 10,865,589 B2
(45) Date of Patent: Dec. 15, 2020

(54) MOTOR VEHICLE DOOR LATCH

(71) Applicant: Kiekert AG, Heiligenhaus (DE)

(72) Inventors: Robert S. Pettengill, Farmington, MI (US); Robert J. Hunt, Davisburg, MI (US)

(73) Assignee: Kiekert AG, Heiligenhaus (DE)

( * ) Notice: Subject to any disclaimer, the term of this patent is extended or adjusted under 35 U.S.C. 154(b) by 430 days.

(21) Appl. No.: 15/846,677

(22) Filed: Dec. 19, 2017

(65) Prior Publication Data

US 2018/0171678 A1 Jun. 21, 2018

Related U.S. Application Data

(60) Provisional application No. 62/436,123, filed on Dec. 19, 2016.

(51) Int. Cl.
*E05B 81/14* (2014.01)
*E05B 81/00* (2014.01)

(52) U.S. Cl.
CPC ..... *E05B 81/15* (2013.01); *E05B 81/14* (2013.01); *Y10T 292/1047* (2015.04); *Y10T 292/1082* (2015.04)

(58) Field of Classification Search
CPC ..... Y10T 292/1082; Y10T 292/308; Y10T 292/1047
See application file for complete search history.

(56) References Cited

U.S. PATENT DOCUMENTS 4,334,704 A * 6/1982 Yamada ..... E05B 79/12 292/216
4,927,204 A * 5/1990 Asada ..... E05B 81/20 292/216
5,897,148 A * 4/1999 Arabia, Jr. ..... E05B 85/243 292/209
6,003,910 A * 12/1999 Dupont ..... E05B 81/14 292/201
6,059,327 A * 5/2000 Yoshikuwa ..... E05B 83/16 292/216
6,079,237 A * 6/2000 Hochart ..... E05B 81/14 292/201

(Continued)

FOREIGN PATENT DOCUMENTS

DE 3414475 C1 * 12/1985 ..... E05B 81/14
DE 10312093 A1 3/2004

(Continued)

OTHER PUBLICATIONS

Written Opinion of related International Patent Application No. PCT/IB2017/001430 dated Jun. 28, 2018.

*Primary Examiner* — Carlos Lugo
(74) *Attorney, Agent, or Firm* — Renner, Otto, Boisselle & Sklar, LLP

(57) ABSTRACT

A motor vehicle door latch is equipped with a locking mechanism including a catch and a pawl, a release element for the locking mechanism, and a memory element that effects an unimpeded opening movement of the catch from a closed to an open position and maintains the release element in an ineffective position in respect of the locking mechanism during the opening movement of the catch. The memory element includes at least two components with a control lever and a blocking lever interacting with the release element located thereon.

18 Claims, 3 Drawing Sheets

(56) References Cited

U.S. PATENT DOCUMENTS

| | | | | |
|---|---|---|---|---|
| 6,267,420 | B1 * | 7/2001 | Miyagawa | E05B 83/16 292/216 |
| 6,575,507 | B2 * | 6/2003 | Reddmann | E05B 81/14 292/201 |
| 7,059,640 | B2 * | 6/2006 | Tensing | E05B 81/14 292/201 |
| 7,467,815 | B2 * | 12/2008 | Larsen | E05B 81/14 292/201 |
| 7,475,920 | B2 * | 1/2009 | Bigazzi | E05B 81/14 292/201 |
| 9,677,305 | B2 * | 6/2017 | Bendel | E05B 81/05 |
| 9,874,046 | B2 * | 1/2018 | Wittelsbuerger | E05B 77/06 |
| 2004/0094971 | A1 * | 5/2004 | Warmke | E05B 81/06 292/201 |
| 2008/0224482 | A1 * | 9/2008 | Cumbo | E05B 77/02 292/216 |
| 2015/0233156 | A1 * | 8/2015 | Scholz | E05B 85/20 292/200 |
| 2018/0171681 | A1 * | 6/2018 | Hunt | E05B 81/20 |

FOREIGN PATENT DOCUMENTS

| | | | | |
|---|---|---|---|---|
| DE | 10 2006 032 033 | A1 | 3/2007 | |
| DE | 10 2006 012 105 | A1 | 9/2007 | |
| DE | 102008009506 | A1 * | 8/2009 | E05B 81/46 |
| DE | 10 2012 017 677 | A1 | 3/2014 | |
| EP | 1669526 | A2 | 6/2006 | |
| FR | 2768761 | A1 * | 3/1999 | E05B 81/20 |
| JP | 3143586 | B2 * | 3/2001 | |
| WO | 2003054332 | A1 | 7/2003 | |
| WO | 2014/036991 | | 3/2014 | |

* cited by examiner

MOTOR VEHICLE DOOR LATCH

This application claims priority to U.S. Provisional Patent Application No. 62/436,123 filed Dec. 19, 2016, which is hereby incorporated herein by reference in its entirety.

The invention relates to a motor vehicle door latch, with a locking mechanism fundamentally comprising a catch and a pawl, furthermore with a release element for the locking mechanism, and with a memory element, which guarantees an unimpeded opening movement of the catch from a closed to an open position and also maintains the release element in an ineffective position with regard to the locking mechanism during the opening movement of the catch.

BACKGROUND

For motor vehicle door latches, the fundamental problem is that, for example, a mechanically initiated opening movement of the locking mechanism does not inevitably also lead to relevant opening of the pertaining motor vehicle door, tailgate, front hood, etc. In fact, for example, the relevant motor vehicle door or flap can be frozen solid. Consequently, the pawl typically lifted from the catch for opening re-engages into the catch after the end of the opening process. As the catch has not opened due to the described blockage of the motor vehicle door, the relevant motor vehicle door latch is closed again. The opening process must consequently be repeated.

In order to control such functional impairments, the state of the art according to DE 10 2006 012 105 A1 works with a drive to lift the pawl and thus to open the locking mechanism. Furthermore, a memory element which is impinged by a spring is executed which keeps the pawl in a lifted position until the catch is opened. To this end, the memory element is maintained adjacent to at least one latch component by means of the relevant spring.

In the class-specific state of the art according to DE 10 2006 032 033 A1, a catch latch is described which is equipped with a storage instrument to maintain the pawl in its release position during rotation of the catch out of its closed position to beyond passing of the pre-ratchet position in a storage position of the storage instrument. For this purpose, the storage instrument comprises a bracing section assigned to a trigger or release element. When the trigger or release element is activated the bracing section steps before a storage step of the catch to reach the storage position. After passing the pre-ratchet position, the bracing section leaves the relevant storage step again.

Within the scope of the also class-specific theory according to DE 10 2012 017 677 A1 or WO 2014/036991 A1 a similar procedure is followed. Because here the memory element maintains the release element in an ineffective position with regard to the locking mechanism during the opening movement of the catch. The pawl is pre-tensioned with the catch in the direction of an external engagement position. Furthermore, a blocking lever interacting with the pawl is assigned to the release element. The blocking lever is located in a frame box around its own axis or rotational axis.

The state of the art has fundamentally been proven, but there is room for improvement. Because the different functions for triggering of the locking mechanism, to execute the actuating movement for triggering and in conjunction with the realized storage position for the described unimpeded opening movement of the catch from its closed to its open position are mainly configured separately from one another. A multitude of constructional elements result. This leads to a protruding and complicated construction on the one hand and can lead to functional defects in particular over long timescales on the other hand. This is where the invention as a whole wishes to provide assistance.

SUMMARY

The invention is based on the technical problem of further developing such a motor vehicle door latch in such a way that the number of components is reduced and as many different functions as possible are condensed.

In order to solve this technical problem a class-specific motor vehicle door latch within the scope of the invention is characterized by the memory element at least being formed in two parts with a control lever and a blocking lever interacting with the release element located thereon.

Within the scope of the invention, in the first instance work therefore takes place with at least a dual component memory element. This memory element ensures an unimpeded opening movement of the catch from its closed position to its open position. Because for this purpose the relevant memory element maintains the release element in an ineffective position with regard to the locking mechanism during the opening movement of the catch. The release element is generally a release lever which is often located coaxially to the pawl.

To open the locking mechanism, the release element or release lever is typically pivoted around its common axis compared to the pawl. This pivoting movement of the release element or release lever is generally takes along the pawl and lifts it from the catch in the closed position of the locking mechanism. To this end, the release lever may possess a tap which interacts with a contour on the pawl or vice versa. The release element or release lever and the pawl are located coaxially in a frame box to this end.

A comparable coaxial location in the frame box is observed for the catch and the control lever as a component of the memory element. Thus, an especially compact construction is provided. Furthermore, the control lever uses the axis or rotational axis of the catch and consequently a common bolt anchored in the frame box as a component of the memory element which defines the relevant catch axis. It is a comparable case for the pawl and the release element or release lever which are commonly located on a bolt which is also anchored in the frame box which defines the common pawl axis. With the aid of the control lever and the blocking lever located thereon and interacting with the release element in accordance with the invention, consequently in the first instance the motor vehicle door latch in accordance with the invention can be opened. To this end, the control lever can be moved mechanically and/or in a motorized manner and in particular by means of an electromotor. Due to the coaxial location with the catch it is sufficient to this end if the control lever is pivoted around the common axis with the catch.

The configuration is generally such that the control lever is pre-tensioned with a spring in the direction of its neutral position and is impinged against the force of a spring for interaction with the release element. In order to therefore transfer the control lever from its neutral position to its working position, it is preferred to impinge the control lever as described mechanically or in a motorized manner or by means of an electromotor until the control lever attains its working position. In the working position the control lever with the blocking lever located thereon ensures that the release element or the release lever is pivoted. The direct consequence of this is that the pawl is simultaneously lifted from the catch. Additional a rotational moment is imparted on the blocking lever in a direction of a contour on the locking mechanism.

The working position assumed by the control lever in a motorized manner or mechanically is now frozen or stored so to speak. The same applies to the position of the release element in its ineffective position compared to the locking mechanism. This takes place until the catch has completed its opening movement with regard to the locking mechanism. Only then does the control lever or generally the memory element leave its storage position. The aforementioned spring assigned to the control lever ensures that the control lever is transferred back from its working position into the neutral position.

The blocking lever is advantageously formed as a two-arm lever. A version as an angular lever has proven especially preferable here. The blocking lever possesses a blocking arm which is set up to interact with the release element. Furthermore, a control arm is provided for as a further component of the blocking lever. The blocking arm interacts with a contour on the locking mechanism. The blocking lever can thus be impinged. The impingement of the blocking lever with the aid of the contour on the locking mechanism leads to the blocking lever being pivoted around its axis defined on the control lever.

To this end, the catch is equipped in detail with the contour impinging the blocking arm of the blocking lever. The functionality is configured in such a way that the contour on the catch lifts the blocking lever from the contour on the locking mechanism as soon as the locking mechanism is opened to beyond a ratchet position. Therefore, as soon as the locking mechanism has left the relevant ratchet position and consequently the opening movement of the catch is practically complete, the contour of the catch then interacting with the blocking arm of the blocking lever ensures that the blocking lever is moved from the contour on the locking mechanism. In detail, the blocking arm of the blocking lever and the release element are equipped with corresponding contact surfaces. With mutual contact, i.e. with mechanical contact of the contact surface on the blocking arm of the blocking lever on the one hand and the interacting contact surface on the release element on the other hand, a pivoting movement of the blocking lever occurs. The pivoting movement of the blocking lever due to the interacting contact surfaces commences as soon as the control lever leaves its neutral position. At the same time, the pertaining spring is pre-tensioned hereby. The pivoting movement of the blocking lever is completed in the working position of the control lever. Due to the pivoting movement of the blocking lever, it can interact with a stop fixed to the housing in the working position of the control lever.

In fact, the configuration in detail is such that the blocking lever is adjacent to the relevant stop fixed to the housing with its control arm in the ineffective position of the release element with regard to the locking mechanism. Furthermore, the blocking lever is braced in this ineffective position of the release element on the relevant stop fixed to the housing. The working position of the control lever corresponds to this. Therefore, as long as the blocking lever with its control arm is adjacent to the stop, the release element is automatically maintained in its ineffective position with regard to the locking mechanism. As a consequence hereof, the pawl is also lifted from the catch. Thus, the catch can accomplish its opening movement in an unimpeded manner. The release element is therefore maintained in its ineffective position in respect of the locking mechanism during the opening movement of the catch. In fact, the release element is blocked in this ineffective position because the blocking lever is interposed and is braced with its control arm on the stop fixed to the housing. The storage position of the memory element corresponds to this.

As soon as the catch has mostly completed its opening movement or the locking mechanism is opened to beyond the ratchet position, the contour on the catch enters into an operative connection with the blocking arm on the blocking lever. The interaction between the contour on the catch and the blocking lever ensures that the blocking lever is lifted from the stop fixed to the housing by means of the pivoting movement triggered with the aid of the contour. This all occurs as soon as the locking mechanism is opened beyond the ratchet position. The ratchet position generally corresponds to the main latching position or main ratchet position. The pivoting of the blocking lever is for the purpose of engaging and disengaging the stop fixed to the housing. Once the housing is disengaged, the spring loaded control lever and blocking lever are free to move away from the release lever. The contour on the locking mechanism or the catch therefore controls the memory element and ensures that the storage position of the memory element is lifted. At the same time, the release element leaves its ineffective position with regard to the locking mechanism hereby. This is easily possible because at this time the catch has fully or almost fully completed its opening movement. The described triggering functions overall, the control movement for the memory element and the change from the storage position to the normal function are executed in a functionally particularly simple, compact and cost-effective manner within the scope of the invention. Because the dual-component memory element is practically sufficient for assumption and implementation of the previously described functions which together with the contour on the catch ensures the relevant functional positions. The number of components, i.e. dual-component memory element and contour, is consequently considerably reduced compared to the state of the art. Cost-related and functional advantages result from this.

BRIEF DESCRIPTION OF THE DRAWINGS

Hereinafter, the invention is explained in further detail on the basis of a sketch which only depicts an execution example. It shows.

DETAILED DESCRIPTION

Figure 1:
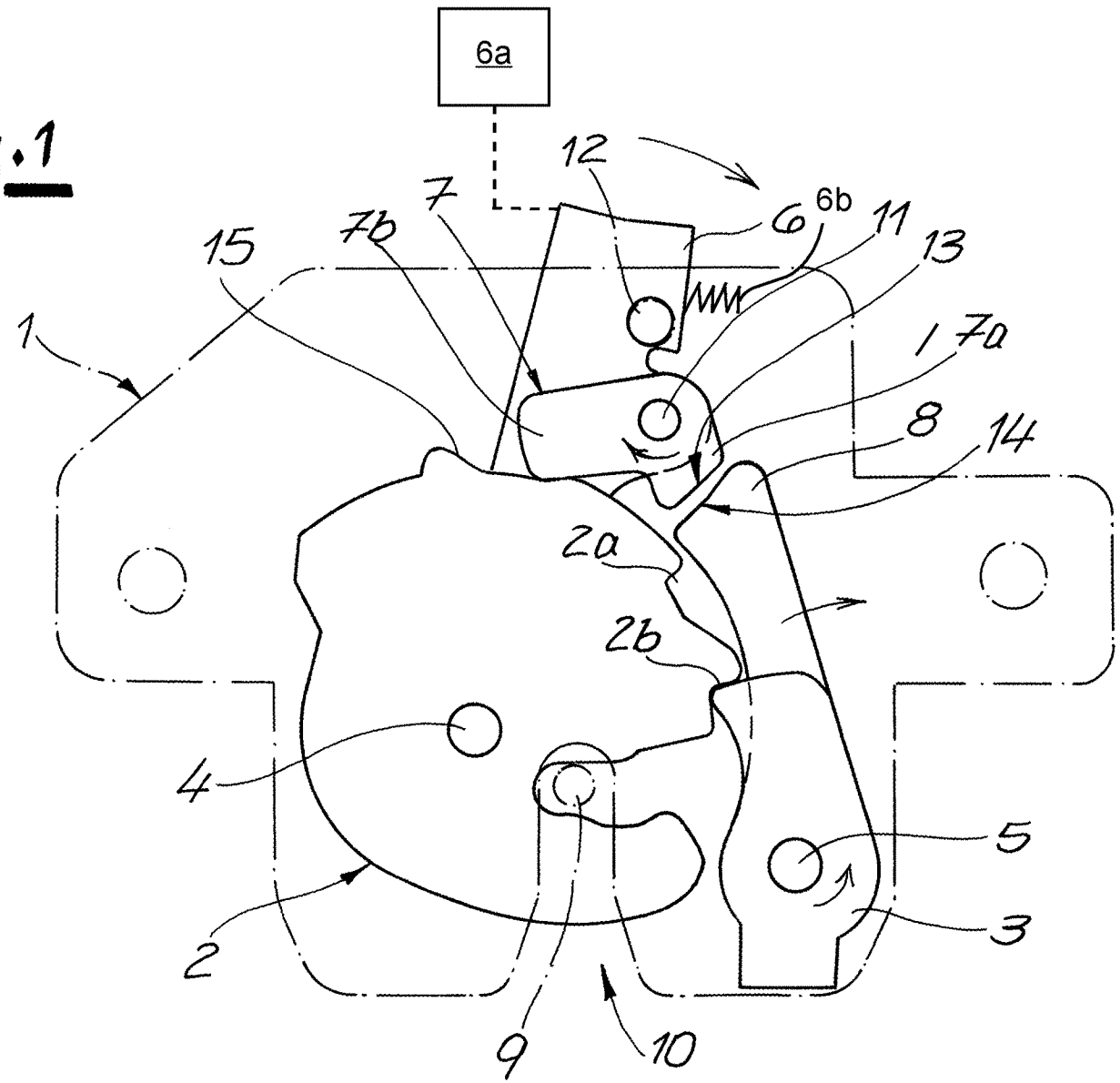
FIG. 1 The motor vehicle door latch according to the invention in its main latching position or main ratchet position, FIG. 2 The motor vehicle door latch according to FIG. 1 in its storage position with the release element in an ineffective position in respect of the locking mechanism and FIG. 3 The motor vehicle door latch according to FIGS. 1 and 2 during leaving of the storage position according to FIG. 2 in the transition to the completely open position.

In the figures a motor vehicle door latch is depicted which possesses a frame box 1 with a locking mechanism 2, 3 located therein consisting of a catch 2 and a pawl 3. In the frame box 1 a bolt is respectively determined to define an axis or rotational axis 4 on the one hand and a further bolt to define a further axis or pawl axis 5 on the other hand. Coaxially to the rotational axis 4 a control lever 6 is located as a component of a dual-component memory element 6, 7 also pivotable compared to the frame box 1. Furthermore, a release element 8 formed as a release lever 8 pertains to the basic construction which is located coaxially to the pawl 3 in the frame box 1 on the pawl axis 5.

In FIG. 1, the locking mechanism 2, 3 is depicted in its main latching position or main ratchet position. In fact, the pawl 2 possesses on the one hand a pre-ratchet recess 2*a* and on the other hand a main ratchet recess 2*b*. In the pre-ratchet position, the pawl 3 engages into the pre-ratchet recess 2*a* in a spring-assisted manner. In contrast, the main ratchet position illustrated in FIG. 1 corresponds to the pawl 3 engaging into the main ratchet recess 2*b* in a spring-assisted manner. To this end, the pawl 3 is pre-tensioned with the aid of a non-illustrated pawl spring in the direction of an anti-clockwise movement with regard to its pawl axis 5. The transition of the catch 2 from an open position depicted in FIG. 3 into the main latching position or main ratchet position according to FIG. 1 occurs as usual by a locking bolt 9 depicted in FIG. 1 engaging into an infeed section 10 of the frame box 1. This takes place as soon as a pertaining motor vehicle door is closed and corresponds to the usual functionality.

As already explained, the memory element 6, 7 in the execution example is at least configured in a dual-component manner and on the one hand possesses the aforementioned control lever 6 located coaxially to the catch 2 and on the other hand a pivotably located control lever 6 and a blocking lever 7 interacting with the release element or release lever 8. The blocking lever 7 is configured as a two-arm lever. In fact, the blocking lever 7 in the execution example is an angular lever with a blocking arm 7*a* on the one hand and a control arm 7*b* on the other hand which stretch respectively at an angle compared to the rotational axis 11 defined on the control lever 6. The construction finally comprises a stop 12 fixed to the housing. The stop 12 fixed to the housing is generally located in or on a housing or housing lid which is not illustrated and stretches above the frame box 1 coinciding with the respective drawing plane so to speak.

It operates as follows. FIG. 1 illustrates the motor vehicle door latch or its locking mechanism 2, 3 in the main latching position or main ratchet position. The pawl 3 is engaged into the main ratchet recess 2*b* of the catch 2. The locking bolt 9 is caught. In order to open the locking mechanism 2, 3 starting from this main ratchet position or main latch position, the control lever 6 is impinged in the execution example. To this end, the control lever 6 is pivoted in the indicated clockwise direction around its common axis 4 with the catch 2 starting from its neutral position illustrated in FIG. 1. To this end, the control lever 6 can be mechanically impinged by an impingement mechanism 6*a*. However, a motor and in particular an electromotor can be the impingement mechanism 6*a* and generally ensures the relevant pivoting movement of the control lever 6. Thus, the locking mechanism 2, 3 can be opened via remote control.

The impingement of the control lever 6 leads to the control lever 6—as described—being pivoted in a clockwise direction coaxially to the catch axis 4 according to the execution example. This occurs against the force of a spring 6*b*. In fact, the relevant spring 6*b* for impingement of the control lever 6 ensures that it is pre-tensioned in the direction of its neutral position illustrated in FIG. 1. The aforementioned motor or electromotor 6*a* consequently needs to work against the force of the spring 6*b* in order to transfer the control lever 6 from its neutral position illustrated in FIG. 1 into its working position as illustrated at the end of the control movement in FIG. 2.

Figure 2:
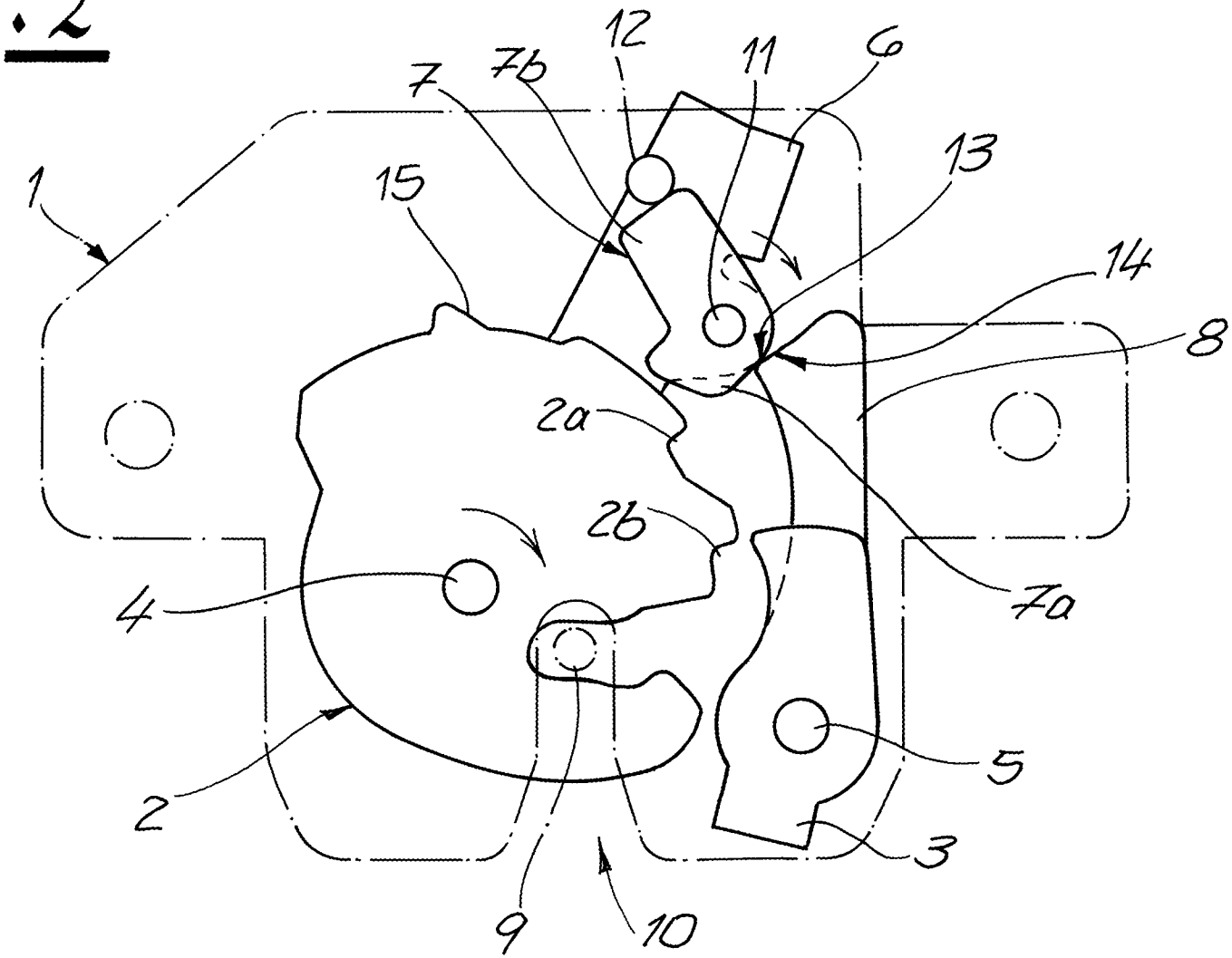

In the transfer of the control lever 6 from its neutral position according to FIG. 1 into the working position according to FIG. 2, the blocking lever 7 configured as a two-armed lever or an angular lever comes into contact with the release element or release lever 8. As a consequence hereof, the release lever 8 is transferred and maintained during transition from the main ratchet position according to FIG. 1 to the storage position illustrated in FIG. 2 and explained in further detail hereinafter into an ineffective position in respect of the locking mechanism 2, 3. In fact, the pivoting movement of the control lever 6 ensures with the blocking lever 7 located thereon that corresponding contact surfaces 13, 14 come into mutual contact on the blocking lever 7 on the one hand and the release lever 8 on the other hand. The contact surfaces 13, 14 on the blocking lever 7 on the one hand and the release lever 8 on the other hand glide along one another. The mutual contact of the contact surfaces 13, 14 now leads to a pivoting movement of the blocking lever 7, during transition from FIG. 1 to FIG. 2 in terms of an indicated clockwise movement around its axis 11.

At the same time, by the adjacency of the blocking lever 7 or the described movement of the control lever 6 the release lever 8 is pivoted as indicated in a clockwise direction around its common axis 5 with the pawl 3. As a consequence hereof, the release lever 8 takes along the pawl 3 and lifts it from the catch 2. This can occur by a reciprocal engagement of a tap into a contour between the release lever 8 and the coaxially located pawl 3 and is not depicted in detail. In the storage position of the memory element 6, 7 according to FIG. 2 the release element or release lever 8 assumes its ineffective position with regard to the locking mechanism 2, 3. Because the previously described pivoting movement also in a clockwise direction of the release lever 8 results in the pawl 3 being taken along around the common axis 5 in this pivoting movement in a clockwise direction. Thus, the pawl 3 becomes disengaged from the catch 2. The pawl 3 is lifted from the catch 2 during transition from FIG. 1 to FIG. 2 in respect of the main ratchet recess 2*b*.

As a consequence hereof, the catch 2 in the functional position can be opened in a spring-assisted manner according to FIG. 2. In fact, a non-illustrated spring impinging the catch 2 ensures that the catch 2 accomplishes a clockwise direction movement around its axis 4 in this opening process, as illustrated in FIG. 2.

At the same time, in the transition from FIG. 1 to FIG. 2, it is apparent that the mutual contact of the contact surfaces 13 on the blocking lever 7 and 14 on the release lever 8 during the pivoting movement of the control lever 6 cause the blocking lever 7 to accomplish a pivoting movement around the axis 11. At the end of this pivoting movement of the blocking lever 7 in a clockwise direction around the axis 11 its control arm 7*b* lies adjacent to the stop 12 fixed to the housing. Furthermore, the blocking arm 7*a* is driven against the catch 2 or is located near or adjacent to the relevant catch 2.

As the release element or release lever 8 is blocked via the blocking lever 7 bracing the stop 12 fixed to the housing in respect of the housing or motor vehicle door latch housing the release lever 8 cannot accomplish an anti-clockwise direction movement around its axis 5 initiated by a spring, for example. The pawl 3 is consequently maintained in its raised position in respect of the catch 2 with the aid of the release lever 8. This storage position of the memory element 6, 7 or the corresponding ineffective position of the release element 8 in respect of the locking mechanism 2, 3 in FIG. 2 is maintained until the blocking lever 7 is braced and can be braced on the stop 12 fixed to the housing. A contour 15 is provided for to lift this brace. In the execution example, the contour 15 is specifically executed on the catch 2 on the locking mechanism 2, 3. The contour 15 is located beyond the two ratchet recesses 2*a*, 2*b*. The contour 15 can interact with the blocking lever 7 or the blocking arm 7*a* and impinge it as described in further detail hereinafter.

Starting from the storage position in FIG. 2 with the pawl 3 lifted from the catch 2 the indicated clockwise direction movement of the catch 2 or its opening movement around the axis 4 now leads to the contour 15 being able to interact with the blocking arm 7*a* of the blocking lever 7 during the opening process. Because, as already explained, the relevant blocking arm 7*a* of the blocking lever 7 is adjacent to the storage position according to FIG. 2 on the catch 2 or is arranged near to it. As soon as the catch 2 has now completed a certain opening path in its opening movement in a clockwise direction around the axis 4, the contour 15 can interact with the relevant blocking arm 7*a* of the blocking lever 7 and consequently the entire blocking lever 7. This happens as soon as the locking mechanism 2, 3 is opened to beyond a ratchet position. Within the scope of the execution example, an opening movement or an opening path 2 of the catch corresponds to this which corresponds to the main ratchet recess 2*b* and also the pre-ratchet recess 2*a* having passed the pawl 3 so to speak. Consequently, even with the pawl 3 no longer raised an interaction is no longer possible with the relevant ratchet 2*a*, 2*b*. This is shown in FIG. 3.

As soon as the contour 15 can now interact with the blocking lever 7, the contour 15 lifts the blocking lever 7 from the stop 12 fixed in the housing. Because as soon as the contour 15 on the catch 2 interacts with the blocking lever 7, this leads to the blocking lever 7 accomplishing the pivoting movement in an anti-clockwise direction around its axis 11 indicated in FIG. 3 in respect of the control lever 6. The control lever 6 is still in its working position. An electromotor ensuring this is switched off.

Figure 3:
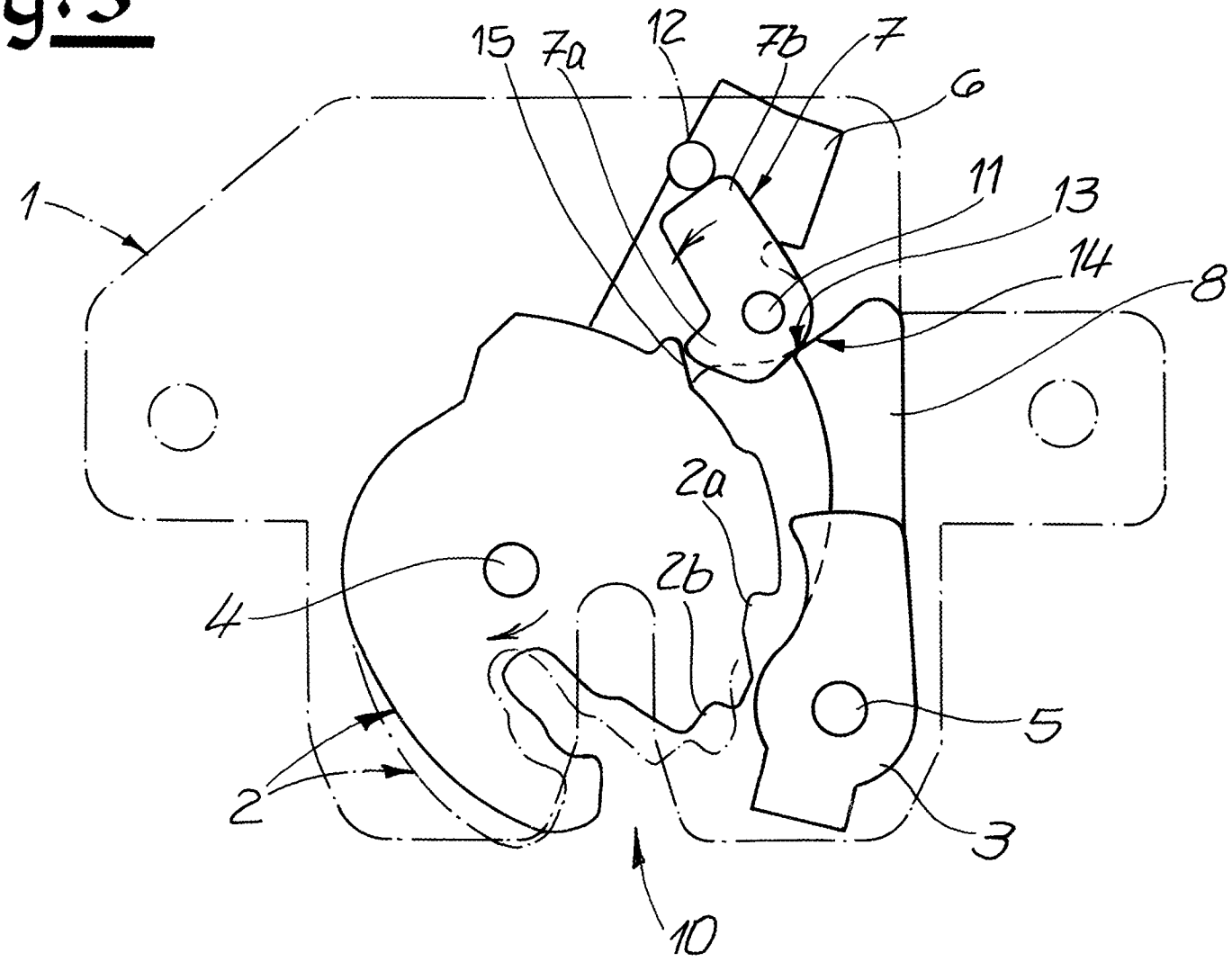

As soon as the blocking lever 7 located on the control lever 6 now accomplishes the anti-clockwise direction movement around its axis 11 indicated in FIG. 3 and is thus released from the stop 12 fixed to the housing, the control lever 6 can be returned impinged by the aforementioned spring tensioned in the working position of the control lever 6 directly into the neutral position according to FIG. 1. As a consequence hereof, the release lever 8 is also pivoted in an anti-clockwise direction compared to its axis 5 in a spring-assisted manner. A similar case applies to the pawl 3.

However, as in the functional position in FIG. 3 the locking mechanism 2, 3 or the catch 2 is already opened beyond its ratchet position, consequently the pawl 3 can neither be engaged in the pre-ratchet recess 2*a* nor the main ratchet recess 2*b*, if the catch opens completely following the functional position according to FIG. 3 and releases the locking bolt 9 previously caught in the main ratchet position according to FIG. 1. The relevant motor vehicle door can be completely opened without the necessity of a further opening process. Now the motor vehicle door latch is located in its completely open position and can be transferred again to the main latching position or main ratchet position according to FIG. 1 starting from here as soon as the pertaining motor vehicle door is closed and the locking bolt 9 enters the infeed section 10.

What is claimed is:

1. A motor vehicle door latch comprising:

a frame box;

a locking mechanism including a catch, pivotally mounted to the frame box about a catch axis, and a pawl pivotally mounted to the frame box about a pawl axis;

a release element operatively connected to the pawl for operating the pawl between a retaining position, retaining the catch, and a release position, releasing the catch; and a memory element that effects an unimpeded opening movement of the catch from a closed to an open position and maintains the release element in an ineffective position relative to the locking mechanism during the opening movement of the catch, the memory element including a control lever, coaxially mounted to the catch axis, and a blocking lever mounted to the control lever and interacting with the release element, wherein, when the control lever is operated, the control lever is configured to move the blocking lever toward engagement with the release element, the engagement allowing the blocking lever to pivot and move the release element toward moving the pawl into the release position, and also maintaining the release element in the ineffective position.

2. The motor vehicle door latch according to claim 1, wherein the control lever is moved mechanically.

3. The motor vehicle door latch according to claim 1, wherein the control lever is pre-tensioned with a spring in a direction of a neutral position, and is impinged against a force of the spring for interaction with the release element.

4. The motor vehicle door latch according to claim 1, wherein the blocking lever is an angular lever with a blocking arm and a control arm.

5. The motor vehicle door latch according to claim 4, wherein the blocking arm interacts with a contour on the catch.

6. The motor vehicle door latch according to claim 4, wherein the blocking arm of the blocking lever and the release element are equipped with corresponding contact surfaces, which, with mutual contact, lead to a pivoting movement of the blocking lever.

7. The motor vehicle door latch according to claim 1, wherein a contour on the catch lifts the blocking lever from a stop fixed to a housing as soon as when the locking mechanism is opened to beyond a ratchet position.

8. The motor vehicle door latch according to claim 1, wherein the control lever is moved in a motorized manner by an electromotor.

9. A motor vehicle door latch comprising:

a locking mechanism including a pivotally mounted catch and a pivotally mounted pawl;

a release element operatively connected to the pawl for operating the pawl between a retaining position, retaining the catch, and a release position, releasing the catch; and a memory element that effects an unimpeded opening movement of the catch from a closed to an open position and maintains the release element in an ineffective position relative to the locking mechanism during the opening movement of the catch, the memory element including a control lever and a blocking lever mounted to the control lever and interacting with the release element, wherein, when the control lever is operated, the control lever is configured to move the blocking lever toward engagement with the release element, the engagement allowing the blocking lever to pivot and move the release element toward moving the pawl into the release position, and also maintaining the release element in the ineffective position, and wherein the control lever is pre-tensioned with a spring in a direction of a neutral position of the control lever, and is impinged against a force of the spring for interaction with the release element.

10. The motor vehicle door latch according to claim 9, wherein the control lever is moved mechanically.

11. The motor vehicle door latch according to claim 9, wherein the blocking lever is an angular lever with a blocking arm and a control arm.

12. The motor vehicle door latch according to claim 11, wherein the blocking arm interacts with a contour on the catch.

13. The motor vehicle door latch according to claim 11, wherein the blocking arm of the blocking lever and the release element are equipped with corresponding contact surfaces, which, with mutual contact, lead to a pivoting movement of the blocking lever.

14. The motor vehicle door latch according to claim 9, wherein a contour on the catch lifts the blocking lever from a stop fixed to a housing when the locking mechanism is opened to beyond a ratchet position.

15. The motor vehicle door latch according to claim 9, wherein the control lever is moved in a motorized manner by an electromotor.

16. A motor vehicle door latch comprising:

a locking mechanism including a pivotally mounted catch and a pivotally mounted pawl;

a release element operatively connected to the pawl for operating the pawl between a retaining position, retaining the catch, and a release position, releasing the catch;

a memory element that effects an unimpeded opening movement of the catch from a closed to an open position and maintains the release element in an ineffective position relative to the locking mechanism during the opening movement of the catch, the memory element including a control lever and a blocking lever mounted to the control lever and interacting with the release element; and a housing having a stop fixed to the housing, wherein, when the control lever is operated, the control lever is configured to move the blocking lever toward engagement with the release element, the engagement allowing the blocking lever to pivot and move the release element toward moving the pawl into the release position, and also maintaining the release element in the ineffective position, and wherein a contour on the catch lifts the blocking lever from the stop when the locking mechanism is opened to beyond a ratchet position.

17. The motor vehicle door latch according to claim 16, wherein the control lever is moved mechanically or in a motorized manner by an electromotor.

18. The motor vehicle door latch according to claim 16, wherein the blocking lever is an angular lever with a blocking arm and a control arm.

* * * * *